US010920518B2

(12) United States Patent
van der Werf et al.

(10) Patent No.: US 10,920,518 B2
(45) Date of Patent: Feb. 16, 2021

(54) METHOD AND ARRANGEMENT FOR REMOVING A LINER BELOW SURFACE

(71) Applicant: Callidus Capital B.V., Heerenveen (NL)

(72) Inventors: Sven IJme van der Werf, Enschede (NL); Michel Stuiver, Lemmer (NL); Feitze Veenstra, Heerenveen (NL)

(73) Assignee: CALLIDUS CAPITAL B.V., Heerenveen (NL)

( * ) Notice: Subject to any disclaimer, the term of this patent is extended or adjusted under 35 U.S.C. 154(b) by 68 days.

(21) Appl. No.: 16/315,556

(22) PCT Filed: Jul. 7, 2017

(86) PCT No.: PCT/NL2017/050454
§ 371 (c)(1),
(2) Date: Jan. 4, 2019

(87) PCT Pub. No.: WO2018/009067
PCT Pub. Date: Jan. 11, 2018

(65) Prior Publication Data

US 2019/0301256 A1 Oct. 3, 2019

(30) Foreign Application Priority Data

Jul. 7, 2016 (NL) ..... 2017125

(51) Int. Cl.
*E21B 29/02* (2006.01)
*E21B 7/14* (2006.01)
(Continued)

(52) U.S. Cl.
CPC ..... *E21B 29/02* (2013.01); *E21B 7/146* (2013.01); *E21B 47/09* (2013.01); *F23D 14/42* (2013.01)

(58) Field of Classification Search
CPC ..... E21B 29/02; E21B 7/146; E21B 47/09; F23D 14/42
See application file for complete search history.

(56) References Cited

U.S. PATENT DOCUMENTS 4,050,680 A 9/1977 Sweeney
2002/0170713 A1 11/2002 Haugen
(Continued)

FOREIGN PATENT DOCUMENTS

CN 101619649 1/2010
NL 2016455 B 10/2017
(Continued)

OTHER PUBLICATIONS

International Search Report from PCT/NL2017/050454 dated Aug. 24, 2017.

*Primary Examiner* — George S Gray
(74) *Attorney, Agent, or Firm* — Adsero IP

(57) ABSTRACT

A method of removing a liner of a well, the liner comprising a liner material. The method comprises providing a seal in the well for defining an upper and/or lower boundary of a removal space, the space being delimited by at least the seal and the liner and providing oxygen or an oxygen releasing compound in the space. The method further comprises providing an ignition module for igniting the liner material near a lower boundary of the space and activating the ignition for igniting the liner material.

17 Claims, 5 Drawing Sheets

(51) Int. Cl.
*F23D 14/42* (2006.01)
*E21B 47/09* (2012.01)

(56) References Cited

U.S. PATENT DOCUMENTS

| | | | | |
|---|---|---|---|---|
| 2015/0034317 | A1 | 2/2015 | Skjold | |
| 2018/0163496 | A1* | 6/2018 | Oag | E21B 29/02 |
| 2018/0371859 | A1* | 12/2018 | Tondel | E21B 29/02 |
| 2020/0284114 | A1* | 9/2020 | Mahjoub | F42C 9/10 |

FOREIGN PATENT DOCUMENTS

| | | |
|---|---|---|
| WO | WO 91/06742 | 5/1991 |
| WO | WO 2013/135583 | 9/2013 |

* cited by examiner

METHOD AND ARRANGEMENT FOR REMOVING A LINER BELOW SURFACE

RELATED APPLICATIONS

This application is a 35 U.S.C. § 371 national phase application of PCT/NL2017/050454 (WO 2018/009067), filed on Jul. 7, 2017, entitled "Method and Arrangement for Removing a Liner Below Surface", which application claims priority to Netherlands Application No. 2017125, filed Jul. 7, 2016, which is incorporated herein by reference in its entirety.

TECHNICAL FIELD

The various aspects and embodiments thereof relate to removal of a tubing or liner of a field exploitation well.

BACKGROUND

Upon exhaustion of oil fields, they are abandoned. Legislation and other regulations require exploitation companies to close off the wells used for exploitation of the field. More in particular, certain regulations requires the companies to remove the tubing and or the casing of the wells. The casing may have to be removed for a particular length below the surface or seabed, up to reaching a particular formation in the material under the seabed, or to another level.

Removal of the casing surrounded with cement, usually provided in steel, is today effectuated by means of milling. Milling steel is a slow process. Milling steel also generates swarf and other debris which needs to be removed out of all flowlines including the BOP (blow out preventer) system.

WO2013135583A2 discloses a method of closing an abandoned well. Use of thermite—iron oxide mixed with aluminium—is proposed for melting casing of the well, thus providing a plug in the well. Upon cooling of the plug, the plug shrinks. And because the plug is not fused anymore, cracks will occur between the plug and the surrounding rock. These cracks are more difficult to plug than an open well, due to a large chunk of earlier molten and later solidified steel is inside the borehole. Furthermore, the plug comprises aluminium oxide, which is an environmental unfriendly substance.

SUMMARY

It is preferred to provide a method for removal of the casing addressing at least one of the disadvantages of removal methods used today.

A first aspect provides a method of removing a liner of a tubing which liner comprises a liner material. The method comprises providing an oxidiser holding module in the tubing for defining an upper and/or lower boundary of a removal space, the space being delimited by at least the oxidiser holding module(s) and the liner and providing oxygen or an oxygen releasing compound in the space. The method further comprises providing an ignition module for igniting the liner material in the space and activating the ignition for igniting the liner material.

This method works faster and requires less energy than milling. An important reason for the latter point is that burning of iron generates a large amount of energy. Furthermore, the burning of steel produces a powder (iron oxide) and or small droplets so the waste is easier to handle compared to milling.

An embodiment of the first aspect comprises providing an inner wall conduit in the tubing, the inner wall conduit having an outer diameter smaller than an inner diameter of the casing, wherein the space is further delimited by an outer wall of the inner wall conduit.

An advantage of this embodiment is that a relatively small volume is created that may be filled with the oxidiser or oxygen. This is an advantage, in particular when using oxygen, preferably in gaseous state. Exploitation wells may be provided in very deep sea or deep under the ground, on land rather than on sea, and providing a significant amount of oxygen increases the buoyancy of the device, which may affect stability of the device for facilitating the oxidation.

Another embodiment of the first aspect comprises determining a burn rate of the liner material and a length of the liner burnt per unit of time in particular; and lifting the inner wall conduit at a rate substantially equal to the burn rate.

This embodiment provides a reservoir of oxygen or oxidiser to be provided around the burning point of the casing. This is an advantage, as ignition of the casing and a steel casing in particular requires an amount of effort. With this embodiment, the ignition process is to be run only once.

The lifting rate being substantially equal to the burn rate is to be interpreted as an average lifting rate: the arrangement and the inner tube in particular may be lifted at continuously or in intermittently, in phases.

A second aspect provides an arrangement for oxidation of a liner of a well, the liner comprising a liner material. The arrangement comprises an oxidiser holding module for creating a space for holding oxygen or an oxygen releasing compound in the space, a supply line for supplying the oxygen or the oxygen releasing compound to the space and an ignition module for igniting the liner material near a lower boundary of the space.

BRIEF DESCRIPTION OF THE DRAWINGS

The various aspects and embodiments thereof will now be discussed in further detail in conjunction with drawings. In the drawings.

DETAILED DESCRIPTION

Figure 1:
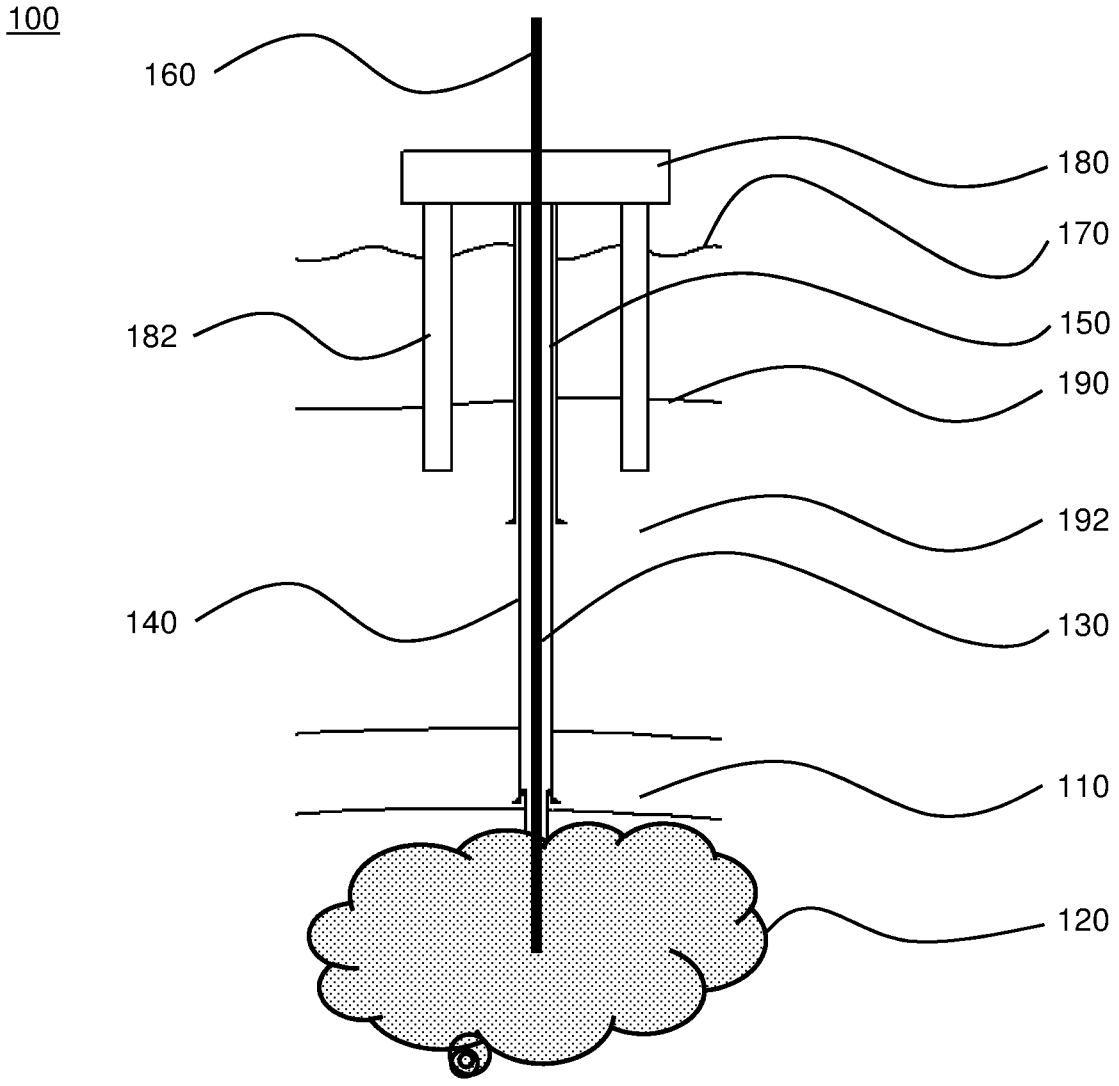
FIG. 1: shows a well exploitation site.

FIG. 1 shows a well exploitation site 100 for hauling oil from an oil reservoir 120 located in a rocky formation 110 underneath a seabed 190.

Below the seabed 190, a mix 192 of various materials may be found, including, but not limited to porous rock, sand, other, or a combination thereof. The rocky formation 110 is impermeable to the resources available in the reservoir 120, like oil. The reservoir 120 may be a cavity holding oil and/or other resources, a porous or spongeous rock formation, other, or a combination thereof, for holding the oil. Above the seabed 190, water is present and above a waterline 170, a platform 180 is provided, supported by bumper piles 182. Alternatively, a floating drilling vessel may be provided.

From the platform 180, a pipeline 160 extends downwardly into an exploitation well 130. The exploitation well 130 is drilled in the rocky formation 110. Within the exploitation well 130, a casing 140 is provided as a liner. The casing 140 preferably comprises steel. Between the casing 140 and the edge of the exploitation well 130, a filling 150 is provided, for example comprising concrete, cement and/or a similar substance.

After either partial or complete exhaustion of the oil reservoir 120, the exploitation site 100 is abandoned. The exploitation site 100 may also be abandoned in case a pit has been drilled, but no oil reservoir has been found. As it is preferred to restore the environment of the exploitation site 100 to a more natural situation, closing and removal of certain parts of the exploitation system is highly preferred. More in particular, part of the casing 140 is to be removed.

Figure 2:
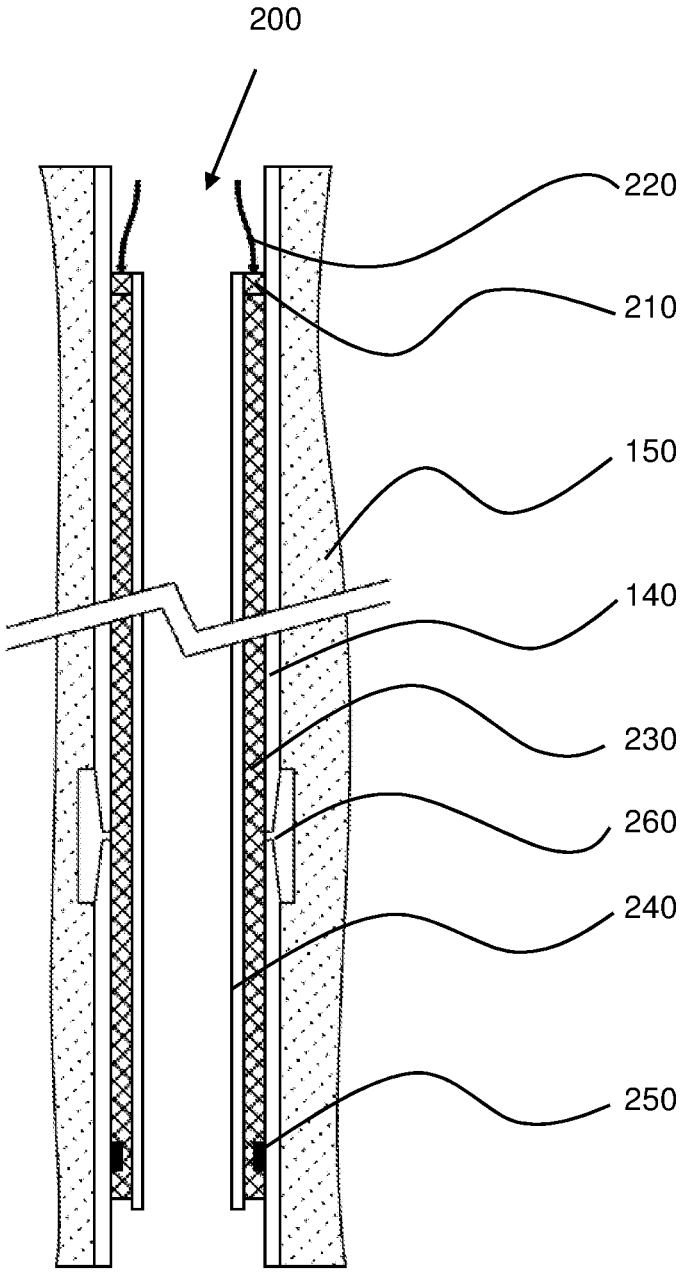
FIG. 2: shows a first arrangement for oxidation of casing of an exploitation well.

FIG. 2 shows the well 130 in further detail. In the well 130, an arrangement 200 for removing the casing is shown. The arrangement 200 comprises an inner tube or a bar/rod 240, an upper seal 210, an oxygen supply conduit 220 and an ignition module 250. Alternatively, multiple ignition modules 250 are provided. The ignition modules 250 may be provided at the same level as shown by FIG. 2. Alternatively or additionally, the ignition modules 250 may be provided at other levels along the inner tube 240. This allows further options if one ignition module 250 should fail and/or if a reaction sparked by one ignition module 250 halts.

FIG. 2 also shows two segments comprised by the casing 140. The two segments connect at a joint 260. The connection or joint 260 may be continuous, with direct contact between the segments or the segments joined by means of a weld. Alternatively, a gap is present between the segments.

For operation, the arrangement 200 is lowered in the well 130 at the removing spot, within the casing 140. At an appropriate depth, the arrangement 200 is installed. In operational situations, the well 130 may be several metres to several kilometres deep, below the seabed 190 or below surface. For proper restoration, the removal of the casing 140 for some tens of meters up to a few hundred meters is sufficient. More in particular, 40 metres to 300 metres of the casing 140 may be removed. More in general, it is preferred the casing 140 is removed at least slightly under the top of the impermeable formation 110. Alternatively or additionally, the casing 140 is removed from the mix 192 of various materials as well, either fully or just below the seabed 190. The part of the casing 140 to be removed may be removed in one batch or by means of multiple batches.

Upon placement of the arrangement 200 at the desired depth, the upper seal 210 is arranged such that it seals a gap between the inner tube 240 and the casing 140 air-tight. The seal is preferably arranged in-situ, to make the lowering of the arrangement 200 more convenient. This may be arranged by providing the upper seal 210 comprising a balloon and/or a hollow tube at the top of the inner tube 240. The tube or balloon may be filled with any appropriate fluid, including water, air or another liquid or gas. Alternatively, the upper seal 210 already provides an air-tight seal while being lowered in the casing 140.

After the gap between the inner tube 240 and the casing 140 has been sealed, oxygen or an oxygen releasing compound is supplied to a space 230 between the casing 140 and the inner tube 240. The oxygen releasing compound is preferably arranged to release oxygen in its gaseous state, as 02(*g*). Preferably, the amount of oxygen is provided is such that the full space 230 is filled with oxygen. In the embodiment shown by FIG. 2, the oxygen or oxygen releasing compound is provided to the space 230 by means of the oxygen supply conduit 220. Alternatively or additionally, oxygen may be provided to the space 230 via an inner space of the inner tube 240. Whereas the first mentioned embodiment allows the inner tube 240 to be used for exhaust of burnt material, this is not possible in the second mentioned embodiment.

It is important that the ignition module 250 is in an area with oxygen. Therefore, the ignition module 250 is provided inside the chamber of the inner tube 240, preferably near the lower end.

In case the ignition module 250 is not yet applied to the casing 140, the ignition module 250 may be applied to the casing 140. The ignition module 140 does not necessarily have to be in direct contact with the casing 140, but may, depending on its properties, be provided in the vicinity of the casing 140. Actuators may be provided to bring the ignition module 250 from an initial position closer to the casing 140, in case required.

The ignition module 250 is arranged to be activated remotely, preferably from the surface. This may be at the waterline 170, from the platform 180 or from a vessel when the well 130 is located below sea. Alternatively, the well 130 is located on land, in which case the ignition is activated from land.

The ignition module 250 is arranged for starting an oxidation reaction of the steel or other material of the casing 140, under presence of oxygen or an oxidiser in gaseous, liquid or solid state. In one particular group of embodiments, the oxidation reaction is started by heating the casing 140 to the ignition temperature of at least one material largely present in the casing 140. If the casing 140 comprises a large amount of iron, the casing 140 is preferably to be heated to a temperature of at least 816 degrees centigrade—and preferably higher.

It is noted 816 degrees centigrade is the ignition temperature of iron in ambient air, at ambient temperature. It is noted that providing a gaseous mixture having an oxygen content of more than 20% and in particular providing pure oxygen lowers the ignition temperature of a material. This applies to iron as well. Therefore, if pure oxygen is provided to the space 230, the ignition module 250 may ignite the casing 140 at a temperature of 500 degrees centigrade—or less.

If oxygen is provided under pressure, the ignition temperature may drop even further. Furthermore, for equal volumes, more oxygen is provided under high pressure than under ambient pressure at sea level. Hence, providing oxygen under pressure higher than ambient at sea level may enhance burn rate. It is noted that below sea level, pressure is higher than above sea level. At a depth of 500 meters, pressure is approximately 51 bar, about 51 hPa. Higher pressure may be achieved by providing additional sealing to the space 230—at the bottom in particular—and providing oxygen under higher pressure.

The heating of the casing 140 may be effectuated by means of various measures. One measure could be providing an ignition module 250 generating an exothermal reaction. Such reaction may be provoked by combining reactants. Examples of such reactants are thermite or ammonium chloride an sodium nitride, oxide and acetylene, ignited by means of a spark, other, or a combination thereof.

Alternatively or additionally, an increased temperature may be established by inductive heating, generating heating by means of friction, by running a high current through the casing 140 or a conductor provided in close contact with the casing 140, applying high pressure to the casing 140, a plasma, other means or a combination of the aforementioned means. In yet another embodiment, the ignition module 250 comprises at least one material or at least one mixture of materials that ignites, combusts, burns or otherwise oxidises under presence of oxygen, an oxygen rich gaseous mixture comprising sufficient oxygen for burning of the casing 140 or a particular oxidiser, at temperatures that are common at locations where the ignition module 250 is provided.

Upon activation of the ignition module 250, the casing will start to oxidise, or, worded differently, to burn: to oxidise in a fierce exothermic reaction. As discussed above, iron requires a temperature of at least 816 degrees centigrade to burn at ambient conditions. When burning, the temperature may rise to approximately 1500 degrees centigrade. This puts a requirement on the material of the inner tube 240 to withstand such heat. Therefore, the inner tube 240 and at least the outer wall, facing the space 230, comprises a heat refractory and/or heat absorbing material and/or a heat resistant material.

Once the burning reaction has started, the casing 140 will continue to burn as long as oxygen is provided or still available to the space 230. Alternatively or additionally, the burning may halt when the burning spot reaches the upper seal 210. Within this context, it is noted the material of the casting 140 moves upward. Alternatively or additionally, the material of the casing 140 may also burn downwardly from the point it was ignited or from another point. If the burning point moves downward, burning stops as the burning point reaches a lower boundary of the space 230. In one particular embodiment, the arrangement 200 comprises sensors for detecting the burning spot. If the burning spot reaches a particular point, for example at a particular distance from the upper seal 210, supply of oxygen to the space 230 is, in a particular embodiment, halted and the burning process will stop. As igniting the material of the casing 140 is a process that requires some effort, it is preferred to only stop the burning process at a point at which a desired amount of the casing 140 has been incinerated. Optionally, also the filling 150 and/or parts of the original formation of the rock or other bottom material of the medium in which the well is provided may be incinerated and/or otherwise affected, including, but not limited to decomposed, pulverised or otherwise. This formation is in FIG. 1 indicated as the mix 192 and the rocky formation 110.

If the burning point of the casing 140 has reached a particular level and the desired amount of the casing 140 has not been incinerated, yet, the arrangement 200 is lifted in another embodiment. The arrangement 200 is lifted such that the burning point remains within the space 230, above the lowest part of the inner tube 240. The lifting of the arrangement may be executed continuously or periodically, such that the burning point remains within a certain interval along the length of the inner tube. For lifting of the arrangement 200 relative to the casing 140, the arrangement may be connected to a hoisting installation provided on a platform or vessel at sea level. This can be done with a coiled tube unit or with a wireline for example or other methods.

Alternatively or additionally, the arrangement 200 is provided with a driving module for locally propelling the arrangement upward along the casing 140. Such driving module would comprise a driving member, comprising an electromotor, a hydraulic motor, a pneumatic motor, other or a combination thereof. Furthermore, such driving module would comprise a propulsion member, comprising a roller, a tracked unit, other, or a combination thereof. The propulsion member is driven by the driving member.

The arrangement 200 may hence be suspended by means of a surface structure for proper positioning of the arrangement relative to the casing 140 or the position of the arrangement 200 may be locally controlled by means of the driving module.

Figure 3:
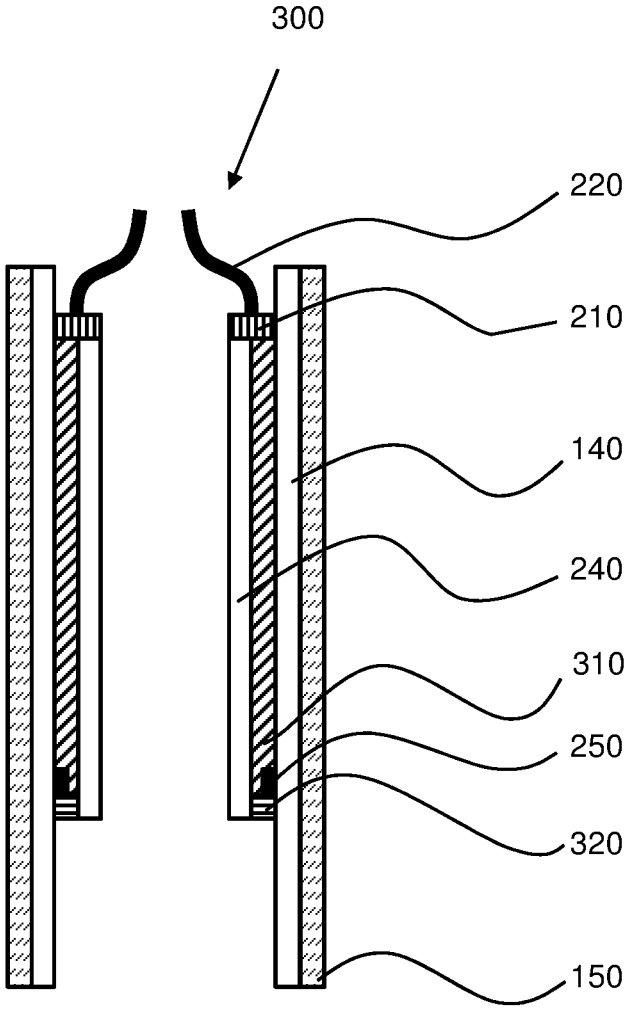
FIG. 3: shows a second arrangement for oxidation of casing of an exploitation well.

FIG. 3 shows another arrangement 300. Like the embodiment described in conjunction with FIG. 2, the arrangement 300 shown by FIG. 3 also facilitates burning of the casing 140. In addition to the upper seal 210, the arrangement 300 comprises a lower seal 320, provided at or near the lower end of the inner tube 240. Rather than filled with oxygen, the space between the outer wall of the inner tube 240 and the inner wall of the casing 140 is filled with a solid oxidiser 310. Such solid oxidiser may be ammonium nitrate, ammonium perchlorate, potassium nitrate or a similar compound. At the bottom of the arrangement 300, no sealing may be required, depending on characteristics of the oxidiser 310 provided. In such case, another oxidiser holding module is provided for holding the oxide. Such oxidiser holding module may be permeable to oxygen or other gases.

Alternatively or additionally, a liquid oxidiser is provided, such as, but not limited to, nitrogen tetroxide or hydrogen peroxide is provided. To prevent the solid oxidiser falling out of the burning space, the lower seal 320 is provided. A liquid oxidiser may not directly fall out of the space 230, but it may mix with other liquids in the well 130, like seawater, other, or a combination thereof. This is not preferred as is could decrease the effectiveness of the oxidiser.

In FIG. 2 and FIG. 3, the embodiments of the various aspects have been disclosed as comprising an inner tube 240. An arrangement comprising such inner tube is preferred, as it reduces an amount of oxidiser—or oxygen—to be contained by the arrangement. In particular in case of oxygen, this reduces the buoyancy of the arrangement, which allows it to be handled in a more stable way.

However, it may also be envisaged to implement the various aspects discussed above also without use of such inner tube 240. In case a gaseous oxidiser or oxygen is provided to the space 230 in the arrangement, only the upper seal 210 is required. In such embodiment, the upper seal 210 seals the casing 140 over the whole cross-section of the casing 140. If a solid or liquid oxidiser is employed and the lower seal 320 is comprised by the arrangement, also the lower seal 320 is provided over the full cross-section of the casing 140.

Figure 4:
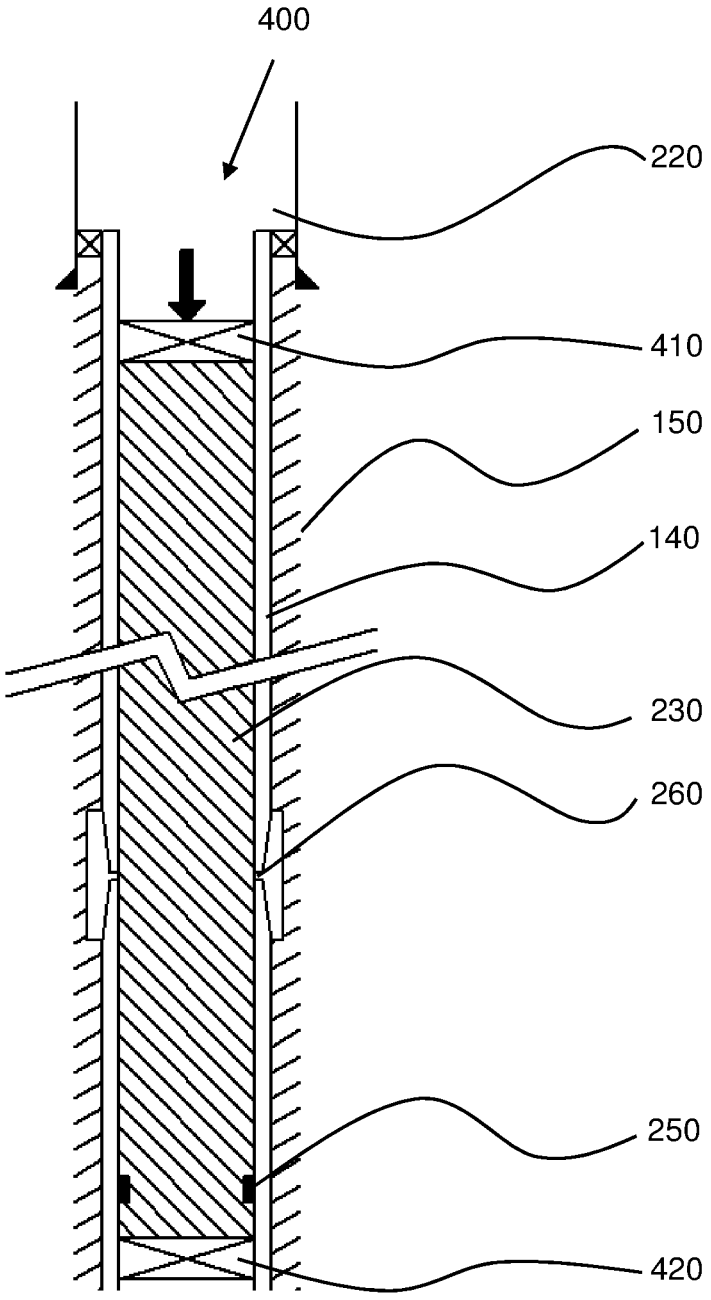
FIG. 4: shows a third arrangement for oxidation of casing of an exploitation well.

If no inner tube 240 is employed, the size of the space 230 is determined by an amount of oxidising gas or oxygen supplied to the arrangement 200. This is depicted in FIG. 4. FIG. 4 shows an arrangement 400. The primary difference between the arrangement 400 and the arrangements shown by FIG. 2 and FIG. 3 is that the inner tube 240 is omitted. Hence, the full inner space between an upper seal 410 and a lower seal 420 is filled with oxide or oxidiser 230

If a liquid and/or solid oxidiser is provided, also the lower seal 320 is present and the size of the space 230 is determined by the distance between the upper seal 210 and the lower seal 320. In case of absence of the inner tube 240, the ignition module 250 may be suspended from the upper seal 210. This may be implemented using flexible suspension units, like wires, or using more rigid suspension units, like rods. Such suspension units preferably comprise material arranged to withstand heat. It is noted this is not necessary, as the ignition module 250 is not required anymore once the material of the casing 140 has been ignited.

A reason for which the casing 140 is to be removed, may be environmental reasons. Therefore, it may be preferred to collect the oxides resulting out of incineration of the casing 140 and, if applicable, out of incineration of the inner tube 240. Iron oxides, a product resulting from oxidation in case of the casing 140 being implemented in steel, are relatively harmless to the environment. Yet, it may still be preferred to recuperate these oxides to prevent any pollution of the environment, to convert the oxides back to iron or for any other reason. To this purpose, a receptacle may be provided below the arrangement.

The receptacle may be connected to the inner tube 240. Alternatively, in particular in an embodiment in which the inner tube 240 is incinerated or otherwise disintegrated or decomposed, the receptacle is not suspended from the inner tube 240. Rather, the receptacle may be suspended independently from the inner tube 240—though yet from the same vessel, platform and/or other system. After the casing 140 is reduced to a desired level, the receptacle is lifted together with or as part of the arrangement.

An alternative is washing oxides away by means of a fluid and a liquid in particular and pumping the mixture of fluid and oxides to the surface for further processing. In another alternative, the oxides are disposed in the well, in the lower part of the casing that is not removed. In yet another alternative, a plug is provided in the casing and the oxides are disposed on that plug. If the arrangement is provided with a lower seal, the lower seal may act as a receptacle. Alternatively or additionally, oxides and iron oxides in particular, droplets of molten steel, either still liquid or solidified, other material or a combination thereof may be collected by means of a magnet.

Figure 5:
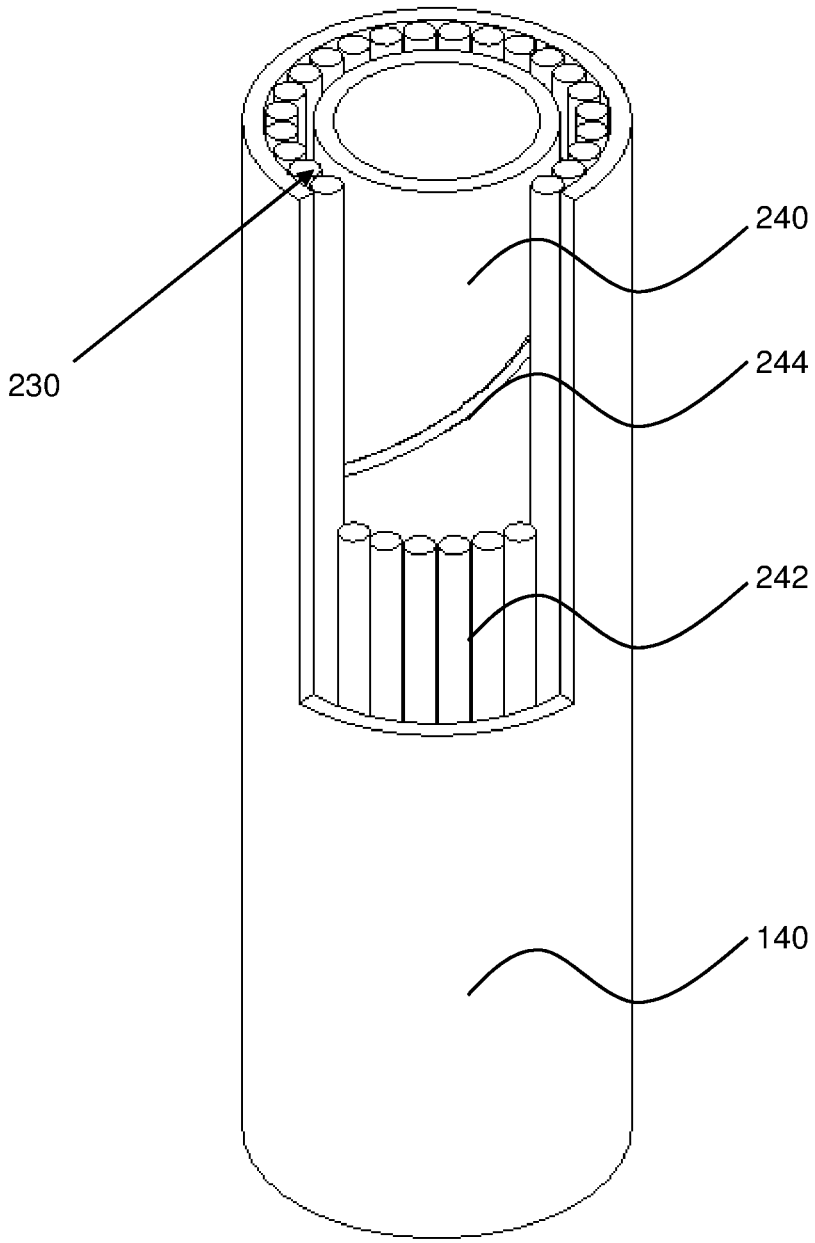
FIG. 5 shows a fourth arrangement for oxidation of casing of an exploitation well.

FIG. 5 shows another embodiment. FIG. 5 shows a detail of the casing 140 with the inner tube 240 provided in the casing 140. Between the casing 140 and the inner tube 240, filaments 242 are provided. The filaments 242 comprise a metal such as iron, any type of steel, magnesium, aluminium other or a combination thereof. Being thin relative to the cross-section of the casing 140, the filaments 242 have a large surface/volume ratio. This allows a relatively high burn efficiency of the filaments 242 relative to the casing 140. This, in turn, facilitates incineration of the casing 140 and reduces any risk of the incineration process of the casing 140 to come to a premature end. In FIG. 5, one layer of filaments 242 is shown. In alternative embodiments, multiple circular layers of filaments 242 may be provided, in concentric circles around the inner tube 240. In one specific embodiment, the diameter of the filaments 242 increases from the inner tube outwardly towards the casing 140.

With the space 230 filled with the filaments 242, less oxygen may be supplied to the burning point compared to an empty space 230. To that purpose, an optional spiral ridge 244 is provided as a spacer between the outer wall of the inner tube 240 and the filaments 242. Additional oxygen—or oxygen releasing compound—may be provided over the path between two parts of the ridge 244. Optionally, otherwise shaped ridges or spacers may be provided, for example as substantially parallel concentric rings.

While burning, incinerating or oxidising the casing 240, the inner tube 240 may be slowly lifted, while the filaments 242 are left in place, becoming shorter and shorter while being burnt. Hence, the filaments 242 may be provided to move independently from the inner tube 240. Such embodiment may be advantageous if the inner tube 240 comprises a refractory or otherwise heat resistant cladding or predominantly comprises such material. In another embodiment, the inner tube 240 and the filaments 242 are connected such that with lifting of the inner tube 240, also the filaments 242 are lifted. Or, in again another embodiment, neither of the inner tube 240 or the filaments 242 are substantially moved relative to the casing 140 and the inner tube 240 and the filaments 242 are burnt with the casing 140 and optionally the filling 150.

In a preferred embodiment, the height of the spacer 244 is the same as the thickness of the filaments 242. In another embodiment, the height of the spacer 244 is half the thickness of the filaments 242. In other embodiments, the spacer 244 may have other dimensions, either thicker or thinner than the diameter of the filaments, in accordance with a particular need of oxygen flow required to support the process of incineration. The spacer may have a semi-circular shape, a rectangular or square shape, a triangular shape, another shape or a combination thereof.

The embodiments above discuss the various aspects in conjunction with a vertical steel or iron tubing in a vertical orientation as casing to a well. Other embodiments may be envisaged as well, in which the tubing has a horizontal orientation, for example for providing a transportation functionality of fluids like crude oil, natural gas, other or a combination thereof. Also such tubing may need to be removed at a certain point in time.

Other methods exist for removing such tubing, as described in Dutch patent application NL2016455, but such options may not provide an optimal result in all situations. In particular in bends other methods may be preferred, like burning the tubing material. In such case, a seal or other oxidiser holding module is provided in the module. Use of an oxygen rich gaseous mixture or pure oxygen is preferred, to prevent having to bring in a significant amount of solid oxidiser. Please note that gravity fill of the tubing is not possible, compared to the embodiment shown by FIG. 1.

A seal is provided from a first side of the horizontal tubing, one or more ignition modules are provided at the bottom of the tubing along a length at which tubing material is to be removed, oxygen is provided to the tubing and the ignition module is activated.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa.

In the description above, it will be understood that when an element such as layer, region or substrate is referred to as being "on" or "onto" another element, the element is either directly on the other element, or intervening elements may also be present.

Furthermore, the invention may also be embodied with less components than provided in the embodiments described here, wherein one component carries out multiple functions. Just as well may the invention be embodied using more elements than depicted in the Figures, wherein functions carried out by one component in the embodiment provided are distributed over multiple components.

A person skilled in the art will readily appreciate that various parameters disclosed in the description may be modified and that various embodiments disclosed and/or claimed may be combined without departing from the scope of the invention.

The invention claimed is:

1. A method of removing a liner of a well, the liner comprising a liner material, the method comprising:

Providing an oxidiser holding module in the well for defining a first boundary of a removal space, the space being delimited by at least the oxidiser holding module transverse of the liner and the liner;

Providing oxygen or an oxygen releasing compound in the space;

Providing an ignition module for igniting the liner material inside the space; and Activating the ignition for igniting the liner material.

2. The method according to claim 1, further comprising providing an inner wall conduit in the well, the inner wall conduit having an outer diameter smaller than an inner diameter of the liner, wherein the space is further delimited by an outer wall of the inner wall conduit.

3. The method according to claim 2, wherein the inner wall conduit comprises a continuous inner hollow space along its length, having an opening and a top at opposite ends and the oxygen or an oxygen releasing compound is provided to the space via the inner hollow space.

4. The method according to claim 2, wherein the inner wall conduit comprises one of the following types of material:

A heat refractory material;

A heat resistant material;

A heat absorbing material; or

A material that decomposes or disintegrates under influence of the oxidation of the liner.

5. The method according to claim 1, wherein the well is substantially vertically oriented and the oxidiser holding module defines an upper and/or lower boundary of the removal space.

6. The method according to claim 5, further comprising providing the oxidiser holding module at the top of the inner wall conduit.

7. The method according to claim 1, wherein the oxygen releasing compound or oxygen is provided in a gaseous or liquid state and the oxidiser holding module comprises a liquid-tight and/or air-tight seal defining an upper boundary of the space.

8. The method according to claim 1, wherein the oxygen releasing compound is a liquid or solid oxidiser and the oxidiser holding module defines a lower boundary of the space.

9. The method according to claim 1, wherein the oxygen or the oxygen releasing compound is provided to the space in a substantially continuous way.

10. The method according to claim 1, further comprising collecting at least one reaction product of the oxidation of the liner material.

11. An arrangement for oxidation of a liner of a well, the liner comprising a liner material and the arrangement comprising:

An oxidiser holding module transverse of the liner for creating a space for holding oxygen or an oxygen releasing compound in the space;

A supply line for supplying the oxygen or the oxygen releasing compound to the space;

An ignition module for igniting the liner material near a lower boundary of the space.

12. The arrangement according to claim 11, further comprising an inner wall conduit having an outer diameter smaller than an inner diameter of the liner, the inner wall conduit further comprising an outer wall for further delimiting the space.

13. The arrangement according to claim 12, wherein the inner wall conduit ranges at least from the oxidiser holding module to the ignition module.

14. The arrangement according to claim 12, wherein the ignition module is provided at a lower end of the inner wall conduit.

15. The arrangement according to claim 11, further comprising elongate filaments provided in the space over the length of the space.

16. The arrangement according to claim 12, further comprising a spacer at the outer wall of the inner wall conduit.

17. The arrangement according to claim 16, wherein the spacer comprises at least one of the following shapes:

A spiral around the inner wall conduit;

Substantially parallel circles around the inner wall conduit;

Semi-circular ridges; or

Substantially rectangular ridges.

* * * * *